US010578262B2

(12) United States Patent
Green et al.

(10) Patent No.: US 10,578,262 B2
(45) Date of Patent: Mar. 3, 2020

(54) SYSTEMS AND METHODS FOR RETROFITTING LIGHT FIXTURES

(71) Applicant: Orion Energy Systems, Inc., Manitowoc, WI (US)

(72) Inventors: Scott A. Green, Ponte Vedra Beach, FL (US); Mahendra J. Macwan, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 0 days.

(21) Appl. No.: 15/849,540

(22) Filed: Dec. 20, 2017

(65) Prior Publication Data

US 2018/0172228 A1 Jun. 21, 2018

Related U.S. Application Data

(60) Provisional application No. 62/437,378, filed on Dec. 21, 2016.

(51) Int. Cl.

| | |
|---|---|
| ***F21S 8/00*** | (2006.01) |
| ***F21V 21/00*** | (2006.01) |
| ***F21S 8/04*** | (2006.01) |
| ***F21V 21/03*** | (2006.01) |
| ***F21S 8/02*** | (2006.01) |
| ***F21V 23/00*** | (2015.01) |
| *F21V 17/02* | (2006.01) |
| *F21V 17/16* | (2006.01) |
| *F21V 21/04* | (2006.01) |

(52) U.S. Cl.

CPC ..... *F21S 8/043* (2013.01); *F21S 8/026* (2013.01); *F21V 21/03* (2013.01); *F21V 23/009* (2013.01); *F21S 8/04* (2013.01); *F21V 17/02* (2013.01); *F21V 17/162* (2013.01); *F21V 21/045* (2013.01)

(58) Field of Classification Search

CPC . F21S 8/043; F21S 8/026; F21S 8/028; F21V 17/02; F21V 21/03; F21V 17/16; F21V 17/162; F21V 17/166; F21V 17/168; F21V 21/04; F21V 21/044; F21V 21/045; F21V 21/046; F21V 21/14

See application file for complete search history.

(56) References Cited

U.S. PATENT DOCUMENTS

| | | | | |
|---|---|---|---|---|
| 5,707,143 | A * | 1/1998 | Hentz | F21S 8/02 362/147 |
| 2006/0198146 | A1* | 9/2006 | Lippis | E04B 9/006 362/277 |
| 2015/0292719 | A1* | 10/2015 | Park | F21V 21/049 362/217.12 |
| 2016/0356475 | A1* | 12/2016 | Honda | F21V 25/12 |
| 2018/0142871 | A1* | 5/2018 | Morales | F21V 21/14 |

* cited by examiner

*Primary Examiner* — Y M. Lee
(74) *Attorney, Agent, or Firm* — Foley & Lardner LLP

(57) ABSTRACT

A retrofit assembly for retrofitting an existing light fixture having an existing housing includes a base, a first mounting member selectively repositionable relative to the base, the first mounting member including a first flange configured to selectively couple the first mounting member to the existing housing, a second mounting member selectively repositionable relative to the base, the second mounting member including a second flange configured to selectively couple the second mounting member to the existing housing, and a lighting element coupled to the base.

12 Claims, 10 Drawing Sheets

SYSTEMS AND METHODS FOR RETROFITTING LIGHT FIXTURES

CROSS-REFERENCE TO RELATED APPLICATIONS

This Application claims the benefit of U.S. Provisional Patent Application No. 62/437,378, filed on Dec. 21, 2016, which is incorporated herein by reference in its entirety.

BACKGROUND

Light fixtures, such as those for interior lighting applications, include light sources secured to enclosures. The light sources may contain various lighting elements (e.g., fluorescent elements, metal halide fixtures, etc.), which may be subject to failure during the useful life of the light fixture. More efficient lighting technologies may additionally or alternatively justify replacing an existing light source. However, the light sources are typically replaced by similar light sources (e.g., a failed fluorescent light fixture may be replaced by another fluorescent light fixture, etc.) because it is often difficult to retrofit an existing lighting fixture for operation with a different lighting technology. As a result, existing lighting fixtures are typically limited in their ability to utilize new, and more efficient, light sources. Systems for retrofitting existing lighting fixtures typically require the use of fasteners and lengthy installation by a qualified electrician.

SUMMARY

One embodiment of the present disclosure relates to a retrofit assembly for retrofitting an existing light fixture having an existing housing. The retrofit assembly includes a base, a first mounting member selectively repositionable relative to the base, the first mounting member including a first flange configured to selectively couple the first mounting member to the existing housing, a second mounting member selectively repositionable relative to the base, the second mounting member including a second flange configured to selectively couple the second mounting member to the existing housing, and a lighting element coupled to the base.

Another embodiment of the present disclosure relates to a light fixture includes a housing and a modular assembly. The modular assembly includes a base, a first mounting member selectively repositionable relative to the base, the first mounting member including a first flange configured to selectively couple the first mounting member to the housing, a second mounting member selectively repositionable relative to the base, the second mounting member including a second flange configured to selectively couple the second mounting member to the housing, and a lighting element coupled to the base.

Yet another embodiment of the present disclosure relates to a method of installing a lighting element onto a housing of a light fixture. The method includes extending a mounting member relative to a base, wherein the base comprises the lighting element, the base having a first lateral side and a second lateral side, and extending the mounting member includes projecting the mounting member from the first lateral side of the base. The method further includes positioning the mounting member adjacent the housing of the light fixture, withdrawing the mounting member relative to the base, withdrawing the mounting member includes withdrawing the mounting member toward the second lateral side of the base, and coupling the mounting member to the housing thereby securing the lighting element to the housing of the light fixture.

BRIEF DESCRIPTION OF THE DRAWINGS

The disclosure will become more fully understood from the following detailed description, taken in conjunction with the accompanying figures, wherein like reference numerals refer to like elements, in which:

FIG. 10 is a top perspective view of an endcap for a retrofit assembly for a light fixture, such as the light fixture shown in FIG. 1;

DETAILED DESCRIPTION

Figure 1:
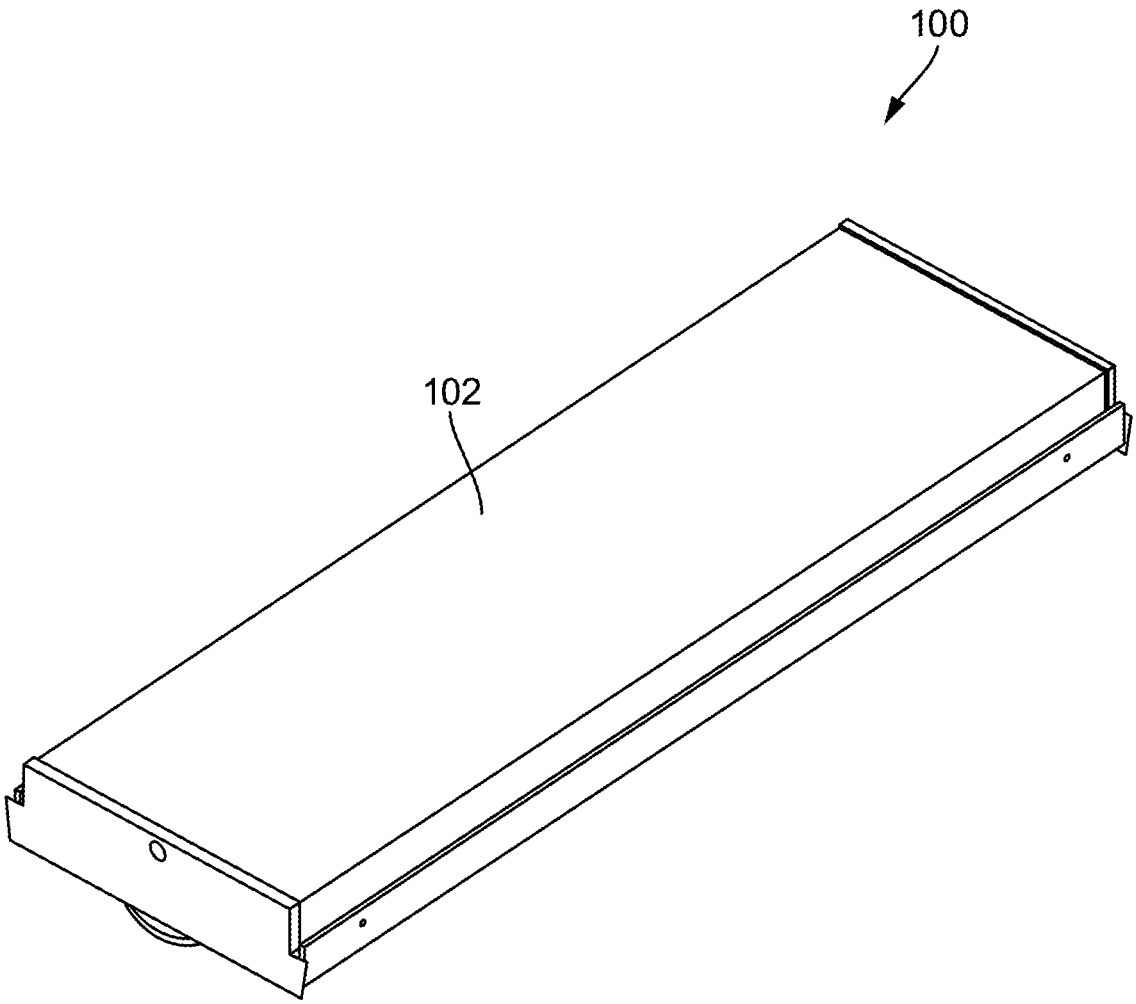
FIG. 1 is a top perspective view of a light fixture, according to an exemplary embodiment.
Figure 2:
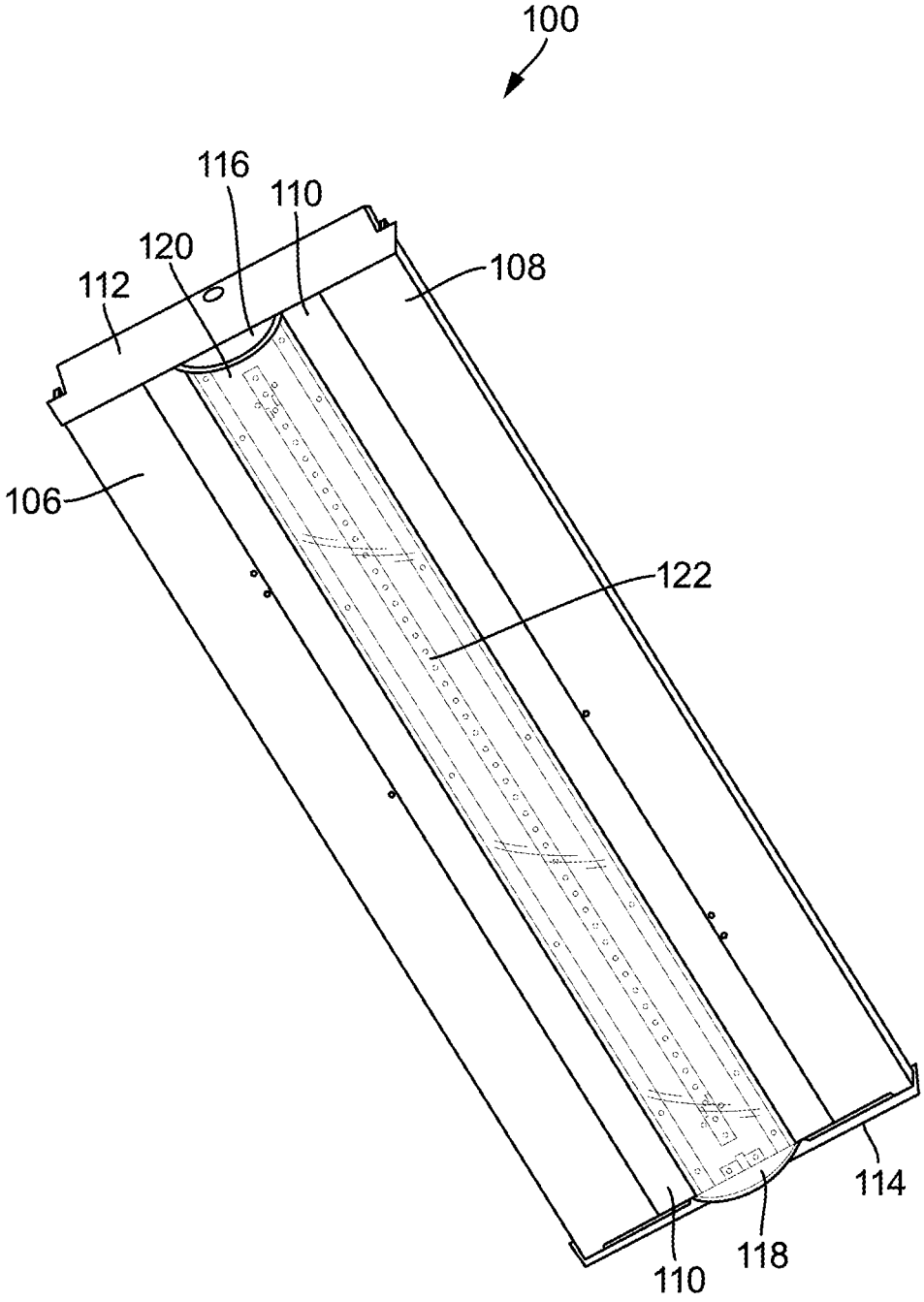
FIG. 2 is a bottom perspective view of the light fixture shown in FIG. 1 in a first configuration.
Figure 3:
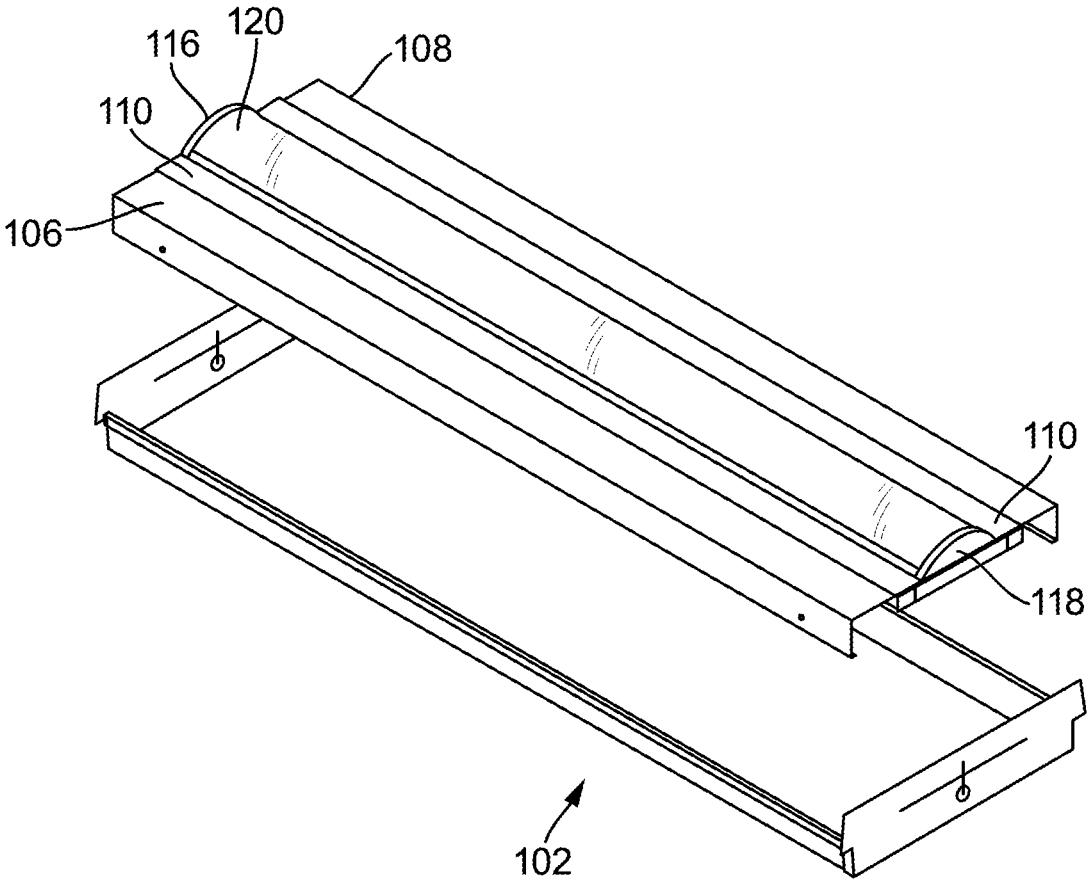
FIG. 3 is a top perspective exploded view of the light fixture shown in FIG. 1 in a first configuration.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a retrofit assembly facilitates retrofitting a light fixture (e.g., troffer, recessed troffer, commercial light, LED fixture, recessed light, high bay fixture, wrap fixture, etc.) and replaces a preexisting lighting element with an LED board. A lens and lighting element of the preexisting lighting fixture may be removed. In some applications, a ballast, ballast plate, and light bulb sockets (e.g., tombstones, etc.) are simultaneously removed and disconnected from the preexisting lighting fixture and/or the input power. Next, the retrofit assembly is installed. The retrofit assembly includes a frame, an LED board, a driver wired to the LED board, and mounting members for coupling the retrofit assembly to a housing of the preexisting lighting fixture, according to an exemplary embodiment. The driver may be coupled to the input power such that electrical power is at least selectively available to the LED board. The mounting members may be selectively repositionable such that the retrofit assembly may be installed in various preexisting lighting fixtures (e.g., fixtures with housings of different widths, etc.). In some applications, the retrofit assembly further includes a coordinating system that facilitates centering the LED board in the light fixture when the retrofit assembly is coupled to the housing. Each of the mounting members includes a flange that is coupled to (e.g., engages, etc.) a flange on the housing when installed such that the retrofit assembly is coupled to the housing. Installation of the retrofit assembly in the housing is designed to be a relatively quick process such that the preexisting lighting fixture is easily retrofit with advanced technology, provided by, for example, the LED board and driver, relative to the preexisting lighting element.

Referring to FIGS. 1-8, a light fixture (e.g., troffer, recessed troffer, commercial light, LED fixture, recessed light, high bay fixture, wrap fixture, etc.), shown as light fixture 100, includes a frame (e.g., body, enclosure, unit, hub, etc.), shown as housing 102. Housing 102 is a housing of an existing lighting fixture (not shown) that is retrofit (e.g., upgraded, etc.) with a new lighting element (e.g., lighting fixture, lamp, etc.) as described herein to arrive at light fixture 100. For example, the existing lighting fixture may be retrofit to effectively replace a previous lighting element (e.g., outdated lighting element, inefficient lighting element, damaged lighting element, etc.) with a new lighting element (e.g., high efficiency lighting element, light emitting diodes (LEDs), etc.). During the retrofitting process, which is described in FIG. 12 in more detail, the previous lighting element is removed from the existing lighting fixture. Removal may include removing a mounting component holding or supporting the previous lighting element to housing 102. As explained herein, light fixture 100 is not specific to a specific housing 102. Instead, light fixture 100 is configured to be implemented with a range of different housings 102 such that various existing lighting fixtures can be retrofit to arrive at light fixture 100.

Light fixture 100 also includes a lens, shown as lens 104. Lens 104 is selectively coupled (e.g., wrapped around, placed, etc.) to housing 102. Lens 104 may be removed as part of the retrofit process.

As shown in FIGS. 2-8, the retrofit assembly, which may be used to retrofit light fixture 100, includes a first member, shown as mounting member 106, a second member, shown as mounting member 108, and a base member, shown as base 110. In other embodiments, the systems and methods utilized herein may be employed in new-construction applications (i.e., although described as a "retrofit assembly," the systems and methods described herein may be employed as part of a new-construction or independent product). In other embodiments, the retrofit assembly does not include one of the mounting members 106 and 108. Mounting member 106 and mounting member 108 may selectively and independently or cooperatively extend from, and retract into, a channel (e.g., guide, etc.) defined by base 110. Mounting member 106 and mounting member 108 may be selectively repositioned without the use of tools (e.g., mounting member 106 and mounting member 108 are free to move with respect to base 110, mounting member 106 and mounting member 108 are held with respect to base 110 by a detent or tool-less fastener, etc.) or with the use of tools (e.g., mounting member 106 and mounting member 108 are held with respect to base 110 by fastener, etc.).

Mounting member 106 and mounting member 108 are each independently operable between a first position (e.g., retracted position, etc.) and a second position (e.g., extended position, etc.). When mounting member 106 and mounting member 108 are in the first position, each of mounting member 106 and mounting member 108 abut base 110. Mounting member 106 and mounting member 108 are in the first position before the retrofit assembly is coupled around housing 102, such as when the retrofit assembly is shipped to a customer (e.g., from a manufacturer of the retrofit assembly, etc.). When mounting member 106 and mounting member 108 are in the second position, a gap is formed between mounting member 106 and base 110 and a gap is formed between mounting member 108 and base 110. These gaps facilitate coupling the retrofit assembly around housing 102 such that the existing lighting fixture is retrofit to light fixture 100. In this way, the selective extension of mounting member 106 and mounting member 108 allows a width of the retrofit assembly to be selectively increased or decreased.

Each of mounting member 106 and mounting member 108 are extendable to a second position that facilitates coupling of the retrofit assembly around a housing 102 having a maximum target dimension (e.g., width, etc.). The mounting member 106 and mounting member 108 each have a maximum extension position that facilitates coupling of the retrofit assembly around a housing 102 having a target dimension, according to an exemplary embodiment.

In various embodiments, the retrofit assembly fits around a housing 102 having a width of between six and eight inches, inclusive. In other embodiments, the retrofit assembly is configured to receive housing 102 having a width of thirteen inches. The maximum position of mounting member 106 and mounting member 108 is related to the width of housing 102. For example, the maximum position of mounting member 106 and mounting member 108 may be selected such that the retrofit assembly is configured to achieve a width of between six and thirteen inches, inclusive. In another example, the maximum position of mounting member 106 and mounting member 108 may be selected such that the retrofit assembly is configured to achieve a width of between six and fifteen inches, inclusive.

Figure 5:
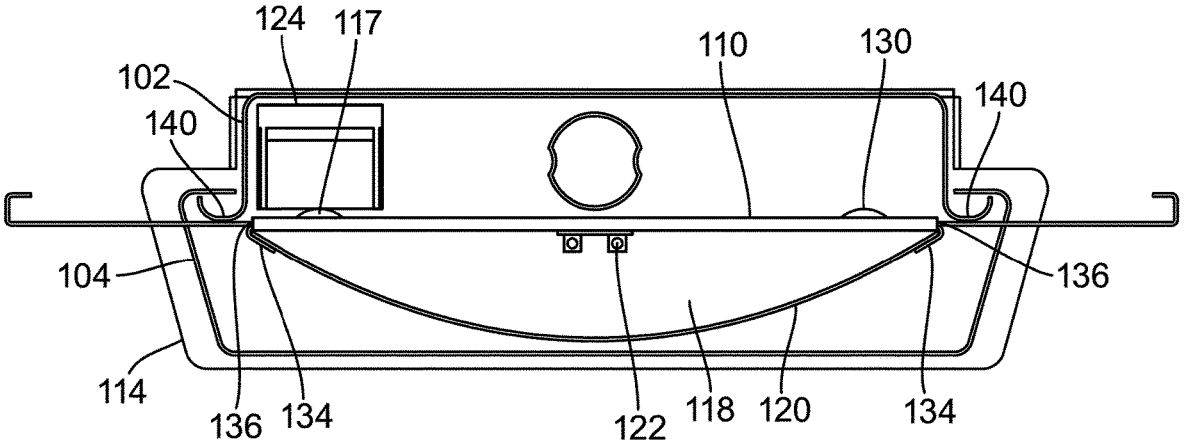
FIG. 5 is a cross-sectional view of the light fixture shown in FIG. 1 in a second configuration.

According to an exemplary embodiment, the retrofit assembly has a width of approximately six and a half inches when each of mounting member 106 and mounting member 108 is in the first position. In various embodiments, mounting member 106 and mounting member 108 may, when at least one of mounting member 106 and mounting member 108 is in the maximum position, provide a width of the retrofit assembly of between, for example, approximately seven inches and approximately fifteen inches, inclusive. FIG. 5 illustrates mounting member 106 and mounting member 108 at a maximum position, according to an exemplary embodiment.

The retrofit assembly also includes a first cap (e.g., cover, etc.), shown as endcap 112, and a second cap (e.g., cover, etc.), shown as endcap 114. When the retrofit assembly is coupled around housing 102, endcap 112 and endcap 114 are each coupled around the retrofit assembly and housing 102. The retrofit assembly also includes a third cap (e.g., cover, etc.), shown as endcap 116, and a fourth cap (e.g., cover, etc.), shown as endcap 118. Endcap 116 and endcap 118 are coupled to base 110 and hold a lens (e.g., cover, etc.), shown as lens 120, there between.

The retrofit assembly also includes a new lighting element (e.g., lighting fixture, lamp, etc.), shown as LED board 122. LED board 122 is coupled (e.g., mounted, attached, etc.) to base 110 between endcap 116 and endcap 118 and covered by lens 120. Lens 120 is configured to substantially cover LED board 122 such that at least a portion of light emitted from LED board 122 passes through lens 120. The retrofit assembly is configured to facilitate electrical coupling (e.g., wiring, connection, etc.) of LED board 122 to a power input (e.g., a mains power supply, etc.). Through the use of LED board 122, light fixture 100 retrofits the existing lighting fixture by replacing the previous lighting element. According to various embodiments, the previous lighting element was a fluorescent light, a fluorescent lamp, etc.

The retrofit assembly also includes a driver (e.g., LED driver, processing circuit, power control, etc.), shown as LED driver 124. According to various embodiments, LED driver 124 is coupled to mounting member 106 or mounting member 108, and not to base 110. LED driver 124 is configured to receive electrical power (e.g., electricity, etc.) from a power source (e.g., electrical supply, electrical wiring, outlet, etc.) and to at least selectively provide the electrical power to LED board 122. In various applications, LED driver 124 may include a controller (e.g., modulator, etc.), such as a dimmer. The dimmer may variably control an output (e.g., current, etc.) of LED driver 124. LED driver 124 may be configured to be electrically coupled to a power source (e.g., electrical source, outlet, etc.) such as a one-hundred and twenty volt power source. The retrofit assembly may provide an electrical ground (e.g., earth, negative, etc.) for LED board 122.

According to various embodiments, LED board 122 includes a plurality of LEDs (e.g., OLEDs, high powered LEDs, RGB LEDs, etc.). LED driver 124 may be configured to power the one or more LEDs of LED board 122. In some embodiments, each LED in LED board 122 is independently controllable (e.g., by color, by intensity, by frequency, etc.) such that a target color, pattern, message, or image can be displayed by LED board 122.

In an exemplary embodiment, LED driver 124 is disposed on a first side (e.g., face, plane, etc.) of the retrofit assembly, shown as top side 126, and LED board 122 is disposed on an opposing second side (e.g., face, place, etc.) of the retrofit assembly, shown as bottom side 128. In some embodiments, top side 126 includes a number of protrusions (e.g., posts, bumps, etc.), shown as dimples 130. According to various embodiments, LED driver 124 is coupled to top side 126 via dimples 130. Dimples 130 may provide clearance for fasteners used to attach LED driver 124 to the retrofit assembly.

The retrofit assembly also includes a battery, shown as battery backup 132. Battery backup 132 is electrically coupled to LED driver 124. For example, battery backup 132 may receive electricity from a power source and provide electricity to LED driver 124. Battery backup 132 may be configured to provide electricity to LED driver 124 in the event that electricity is no longer provided from the power source to the retrofit assembly (e.g., to LED driver 124 directly, to LED driver 124 through battery backup 132, etc.). According to various embodiments, battery backup 132 is coupled to mounting member 106 or mounting member 108, and not to base 110. In an exemplary embodiment, battery backup 132 is coupled to one of mounting member 106 and mounting member 108 and LED driver 124 is coupled to the other of mounting member 106 and mounting member 108. By being coupled to mounting member 106 and/or mounting member 108, LED board 122 may be insulated from heat produced by LED driver 124 and/or battery backup 132. Similarly, by coupling battery backup 132 to one of mounting member 106 and mounting member 108 and coupling LED driver 124 to the other of mounting member 106 and mounting member 108, LED driver 124 may be insulated from heat produced by battery backup 132 and vice versa.

The retrofit assembly also includes a pair of flanges (e.g., channels, guides, etc.), shown as retainers 134, extending from bottom side 128. Retainers 134 may each be disposed along an edge (e.g., side, face, etc.), shown as lateral edge 136, of the retrofit assembly. In some embodiments, retainers 134 are continuous along lateral edge 136. In other embodiments, retainers 134 are discontinuous along lateral edge 136. In some embodiments, retainers 134 are integrated within components of the retrofit assembly. In other embodiments, retainers 134 are coupled (e.g., mounted, attached, etc.) to components of the retrofit assembly.

Retainers 134 are configured to receive (e.g., retain, etc.) lens 120. For example, lens 120 may be one piece of material that is bowed between retainers 134. Lens 120 may be flexible such that flexion of lens 120 allows lens 120 to be received by retainers 134. This flexion may also cause a bias of lens 120 against retainers 134 which assists retainers 134 in holding lens 120. Lens 120 may be removable from retainers 134. For example, lens 120 may be flexible, and lens 120 may be manipulated (e.g., bent, folded, pulled, pushed, etc.) and removed from retainers 134. In some embodiments, lens 120 is removable from retainers 134 when the retrofit assembly is installed in light fixture 100, thereby facilitating access to various components of the retrofit assembly (e.g., LED board 122, etc.). For example, a user may remove lens 120 from retainers 134 when the retrofit assembly is installed in light fixture 100 to replace and/or service LED board 122. According to various embodiments, endcap 116 and endcap 118 are configured to substantially prevent axial movement of lens 120 along retainers 134. For example, endcap 118 may only allow a target amount of movement (e.g., slop, tolerance, etc.) of lens 120.

Figure 4:
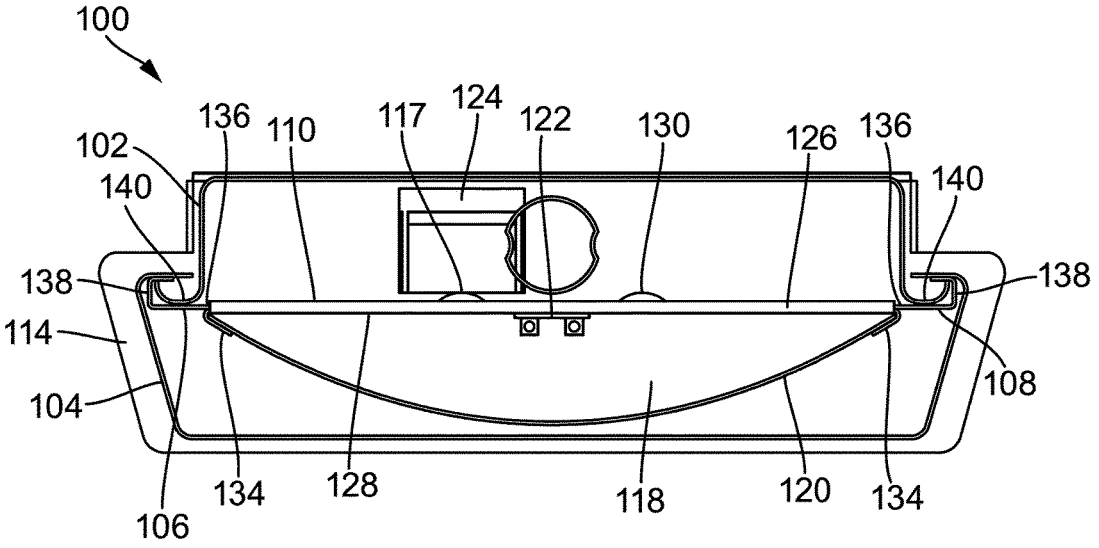
FIG. 4 is a cross-sectional view of the light fixture shown in FIG. 1 in a first configuration.

As shown in FIGS. 4 and 5, each mounting member 106 and/or mounting member 108 includes a structure (e.g., channel, guide, hook, etc.), shown as flange 138. Flange 138 is configured to interface with (e.g., contact, hook over a portion of, etc.) housing 102. Specifically, flange 138 is configured to interface with a structure (e.g., channel, guide, hook, edge, etc.), shown as flange 140, of housing 102, according to an exemplary embodiment. Flange 138 is configured to receive flange 140 and to selectively couple to flange 140 such that the retrofit assembly is supported by (e.g., against the force of gravity, etc.) housing 102. In one embodiment, mounting member 106 and/or mounting member 108 include structure that physically engages a portion of housing 102 to secure the retrofit assembly to the housing 102 (i.e., as a fastener-less installation). In other embodiments, one or more fasteners (e.g., thumb screws, machine screws, self-tapping screws, etc.) are employed to secure mounting member 106 and/or mounting member 108 to the housing 102. According to various embodiments, mounting member 106 and mounting member 108 are configured to maintain the coupling between flange 138 and flange 140 when the retrofit assembly is installed in housing 102. Mounting member 106 may be identical to mounting member 108.

In some embodiments, each mounting member 106 and/or mounting member 108 includes mating features configured to engage corresponding mating features in that mounting member 106 and/or mounting member 108. For example, mounting member 106 and mounting member 108 may be telescopic such that mounting member 106 and/or mounting member 108 is selectively extendable in a target number of successive sections, each section having a target length, such that mounting member 106 and/or mounting member 108 may be selectively extended as a function of each target length.

In other embodiments, mounting member 106, mounting member 108, and/or other components of the retrofit assembly do not have corresponding mating features. In these embodiments, mounting member 106 and mounting member 108 remain selectively and independently repositionable between the second position and the first position. These embodiments of the retrofit assembly may be particularly advantageous in accommodating custom housings 102 of varying widths.

According to an alternative embodiment, mounting member 106 and mounting member 108 are not repositionable and are instead fixed to other components of the retrofit assembly. In these embodiments, mounting member 106 and mounting member 108 have a fixed width. The fixed width may correspond with a standard width of housings, such as housing 102. Mounting member 106 and mounting member 108 having a fixed width may facilitate (e.g., be spaced to facilitate, etc.) a coupling between flange 138 and flange 140. For example, flange 138 may be snap fit onto flange 140. Additionally or alternatively, flange 138 and/or flange 140 may incorporate a selectively engageable latch (e.g., clasp, hook, etc.) for coupling flange 138 to flange 140.

Figure 6:
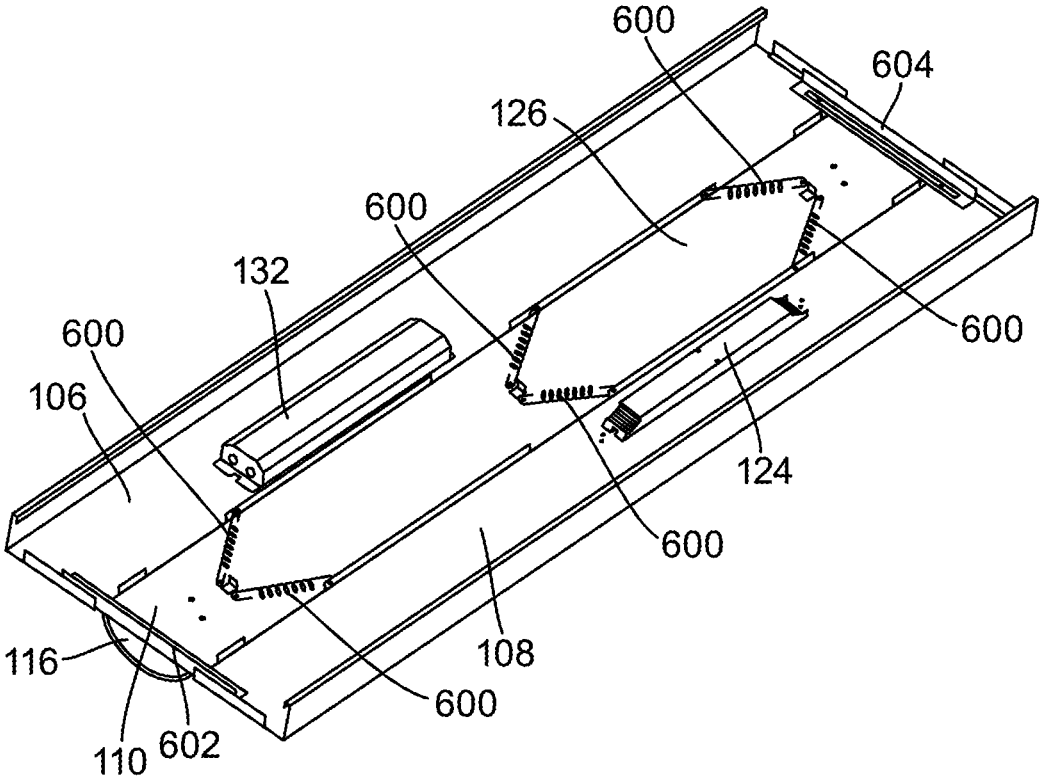
FIG. 6 is a top perspective view of a retrofit assembly for a light fixture, such as the light fixture shown in FIG. 1.
Figure 7:
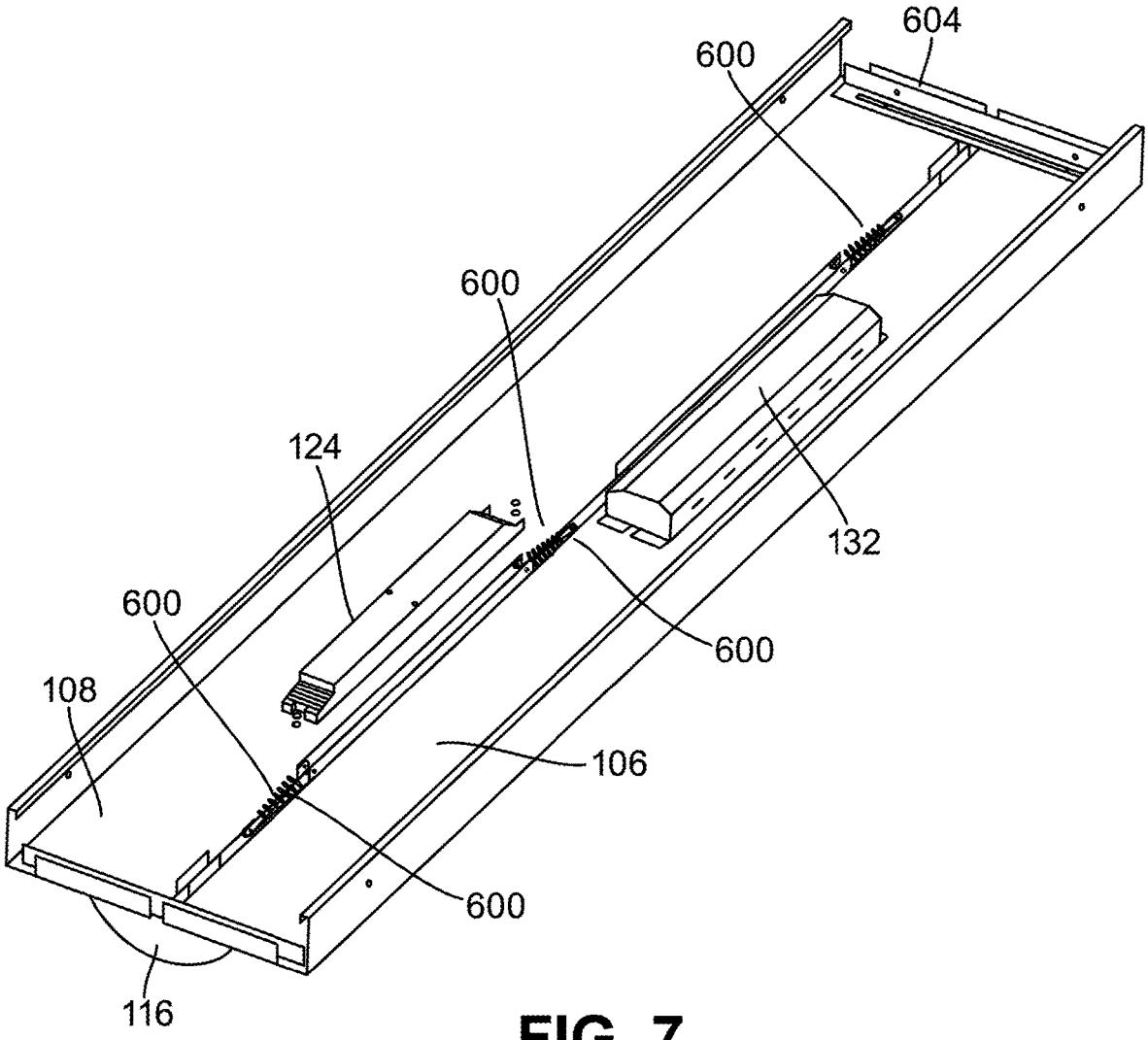
FIG. 7 is a top perspective view of another retrofit assembly for a light fixture, such as the light fixture shown in FIG. 1.
Figure 8:
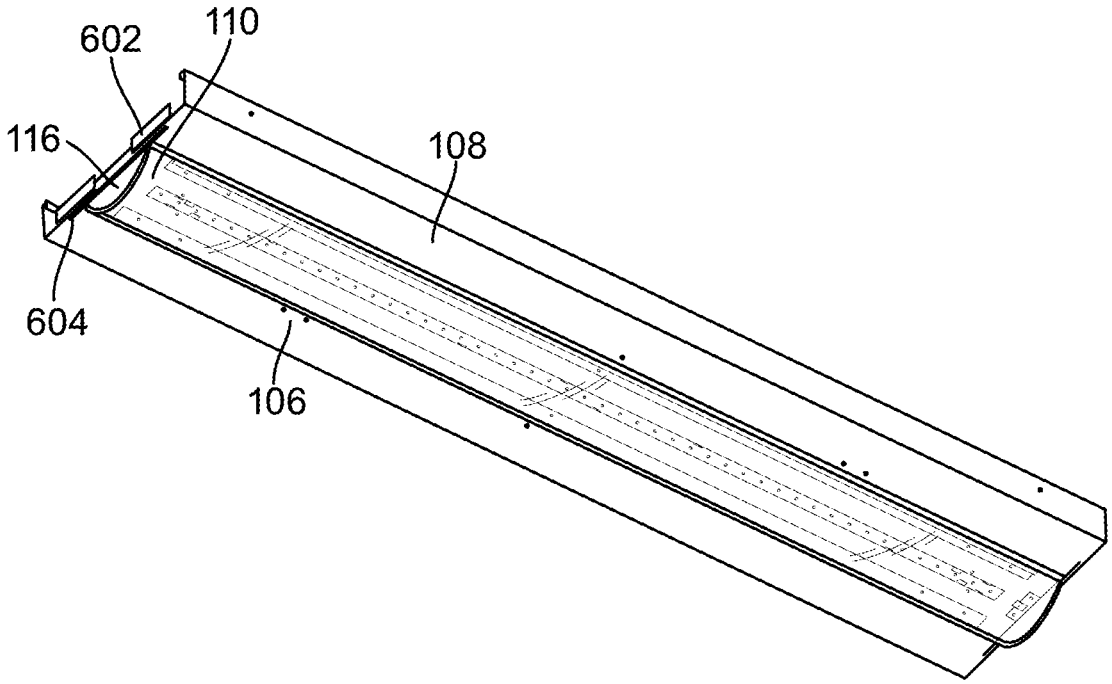
FIG. 8 is a bottom perspective view of a retrofit assembly for a light fixture, such as the light fixture shown in FIG. 1.

In one embodiment, the retrofit assembly further includes one or more coordinating systems (e.g., biasing device, resilient member, gear assembly, etc.) that couple one or more components of the retrofit assembly and/or coordinate movement thereof. As shown in FIG. 6, the coordinating system includes a plurality of resilient members, shown as springs 600. Springs 600 are coupled to the base 110 and mounting member 106 and/or mounting member 108. The retrofit assembly may include, for example, one, two, four, five, or more springs 600. According to an exemplary embodiment, springs 600 are configured to bias mounting member 106 and mounting member 108 inward towards their respective first positions (e.g., towards base 110, etc.). In this way, springs 600 facilitate improved coupling between flange 138 of mounting member 106 and/or mounting member 108 and flange 140. Similarly, when flange 138 of mounting member 106 and/or mounting member 108 and flange 140 are coupled, springs 600 may facilitate repositioning of certain components of the retrofit assembly relative to either flange 140. Springs 600 may coordinate extension and/or retraction of mounting member 106 and mounting member 108 (e.g., to facilitate centering LED board 122, etc.).

Springs 600 may be configured to exert substantially equivalent forces on mounting member 106 and mounting member 108. This equal force draws components of the retrofit assembly towards a center point between flanges 138. In this way, LED board 122 can be easily positioned at a substantially equal distance from each flange 140 and thus centered within housing 102. These embodiments may be particularly advantageous because springs 600 help to ensure uniform installation of the retrofit assembly, which facilitates uniform, predictable, and desirable distribution of light from LED board 122. Springs 600 may assist uniform relative positioning (e.g., centering, etc.) of LED board 122 in housings 102 having various dimensions.

Depending on the application, it may be desirable for mounting member 106 and mounting member 108 to extend from the retrofit assembly substantially simultaneously. Springs 600 may cooperate to facilitate simultaneous extension, retraction, and/or biasing of mounting member 106 and mounting member 108. For example, in one embodiment, both mounting member 106 and mounting member 108 may be temporarily set in the first position, where springs 600 facilitate exertion of substantially equal forces on mounting member 106 and mounting member 108. Following this example, a user may insert the retrofit assembly into housing 102 and then simultaneously release mounting member 106 and mounting member 108 thereby coupling flanges 138 to flanges 140 or another part of housing 102. This embodiment may be particularly advantageous for expedited installation of the retrofit assembly in housing 102.

According to some embodiments, springs 600 are resilient members (e.g., springs, etc.) configured to exert a spring force on mounting member 106 and mounting member 108. In the example shown in FIG. 11, springs 600 include rods with springs positioned over the rods. Following this example, mounting member 106 and mounting member 108 slide along other components of the retrofit assembly, as guided by the rods, and are configured to be biased by the springs. In one embodiment, the springs are substantially similar, and springs 600 are configured to substantially center LED board 122 in housing 102.

Springs 600 may also include threaded rods, bolts, nuts, and other similar components. For example, springs 600 may include tool-less fasteners (e.g., knobs, wheels, etc.) configured to threadably engage a threaded rod such that a user may manually adjust the tool-less fasteners to cause flange 138 to couple to flange 140 (e.g., extend and retract mounting member 106 and mounting member 108, etc.). In some of these applications, the threaded rod is adjustable to cause simultaneous extension or retraction of each of mounting member 106 and mounting member 108.

In other embodiments, the coordinating system includes a pulley assembly. For example, the coordinating system may include a pulley assembly that facilitates coordinated movement of mounting member 106 and mounting member 108. A spring or other resilient member may bias mounting member 106 and mounting member 108 inward. In still other embodiments, the coordinating system includes a gear assembly. For example, the coordinating system may include a gear assembly that coordinates mounting member 106 and/or mounting member 108 movement with a rack and pinion system. By way of example, a gear, sprocket, etc. may be disposed between and couple mounting member 106 and mounting member 108 (e.g., with one mounting member 106 and/or mounting member 108 above and one mounting member 106 and/or mounting member 108 below the gear, sprocket, etc.). The mounting member 106 and mounting member 108 may define or include rack teeth, apertures, etc. configured to interface with the gear, sprocket, etc. to facilitate coordinated mounting member 106 and/or mounting member 108 movement. Additionally, the rack and pinion system may cooperate with pulleys, springs, etc. to provide the bias. In other applications, the coordinating system may utilize a wheel and cog system that coordinates mounting member 106 and/or mounting member 108 movement.

As also illustrated in FIG. 6, the retrofit assembly includes a first bracket (e.g., angle bracket, etc.), shown as bracket 602, and a second bracket (e.g., angle bracket, etc.), shown as bracket 604. Bracket 602 and bracket 604 are fixedly coupled to base 110, and are each movably coupled to mounting member 106 and mounting member 108. Bracket 602 and bracket 604 facilitate coupling of mounting member 106 and mounting member 108 to base 110 why simultaneously facilitating selective repositioning of mounting member 106 and mounting member 108 with respect to base 110.

In one embodiment, mounting member 106 and mounting member 108 having mating features (e.g., bump and detent, a thickness and cavity spacing to provide a friction fit, etc.) corresponding to mating features of base 110, bracket 602, and/or bracket 604. These mating features may cooperate to maintain a position of mounting member 106 and/or mounting member 108 relative to base 110, bracket 602, and/or bracket 604. In some applications, mounting member 106 and mounting member 108 each have a bump configured to be received in a corresponding detent in base 110. For example, base 110 may have a first detent, corresponding to the first position of mounting member 106 and/or mounting member 108, a second detent, corresponding to an intermediate position between the first position and the maximum position of mounting member 106 and/or mounting member 108, and a third detent, corresponding to the maximum position of mounting member 106 and/or mounting member 108. In these embodiments, a user manually repositions each of mounting member 106 and mounting member 108 independently, as desired for housing 102. More or fewer detents may be provided to facilitate retrofitting housing 102 having different widths. These embodiments of base 110 may be particularly advantageous where the particular dimensions of housing 102 are well known and standard for a particular application (e.g., when replacing light fixtures in numerous identical troffer lights, etc.). In other embodiments, base 110 may define bumps, and mounting member 106 and mounting member 108 may define detents. In still other applications, bracket 602 and/or bracket 604 may define bumps or detents (e.g., rather than base 110, in addition to base 110, etc.)

Figure 9:
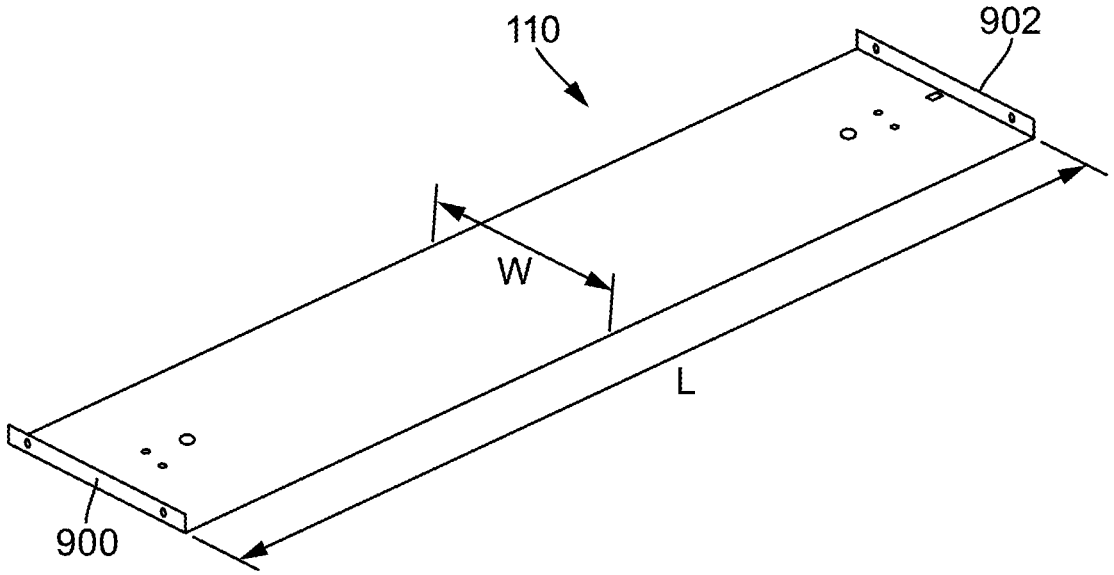
FIG. 9 is a top perspective view of a base for a retrofit assembly for a light fixture, such as the light fixture shown in FIG. 1.

FIGS. 9-12 illustrate components of the retrofit assembly in greater detail. FIG. 9 illustrates base 110 as including a first flange, shown as flange 900, and a second flange, shown as flange 902. Base 110 is defined by a width, w, and a length, l. In some embodiments, the width, w, of base 110 is five inches. In other embodiments, the width, w, of base 110 is eight inches. In some embodiments, the length, l, of base 110 is 47.375 inches.

Figure 10:
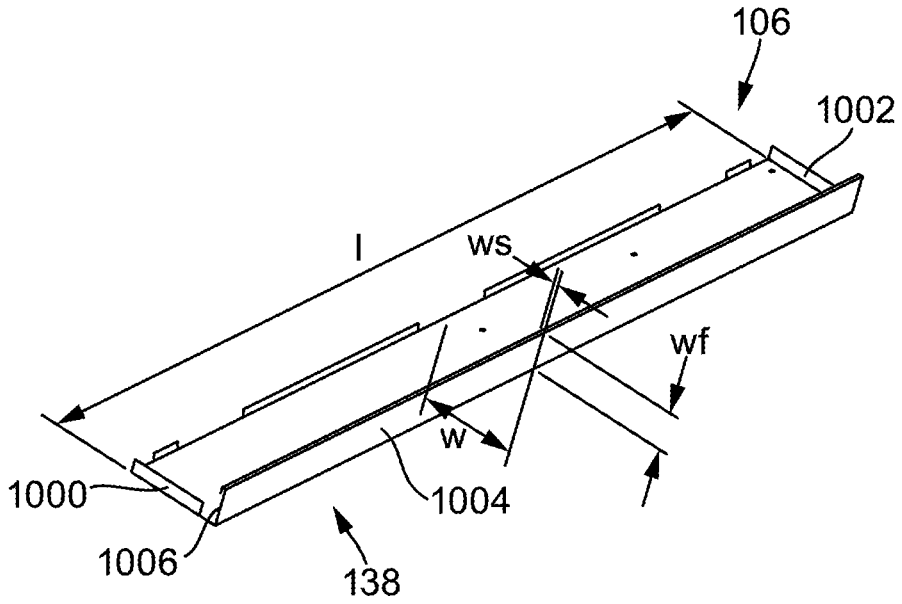
FIG. 10 is a top perspective view of a mounting member for a retrofit assembly for a light fixture, such as the light fixture shown in FIG. 1.

FIG. 10 illustrates mounting member 106 in greater detail, although it is understood that similar detail can be found in mounting member 108. Mounting member 106 includes a first flange, shown as flange 1000, and a second flange, shown as flange 1002. Flange 138 of mounting member 106 is defined by a first portion, shown as a first portion 1004, and a second portion, shown as a second portion 1006. In an exemplary embodiment, first portion 1004 extends substantially orthogonally from mounting member 106, and second portion 1006 extends substantially orthogonally from first portion 1004. Mounting member 106 is defined by a width, w, and a length, l. In various embodiments, the width, w, or mounting member 106 is 4.875 inches. Furthermore, first portion 1004 is defined by a width, wf, and second portion 1006 is defined by a width, ws. In an exemplary embodiment, the width, wf, of first portion 1004 is two inches, and the width, ws, of second portion 1006 is 0.25 inches.

Figure 11:
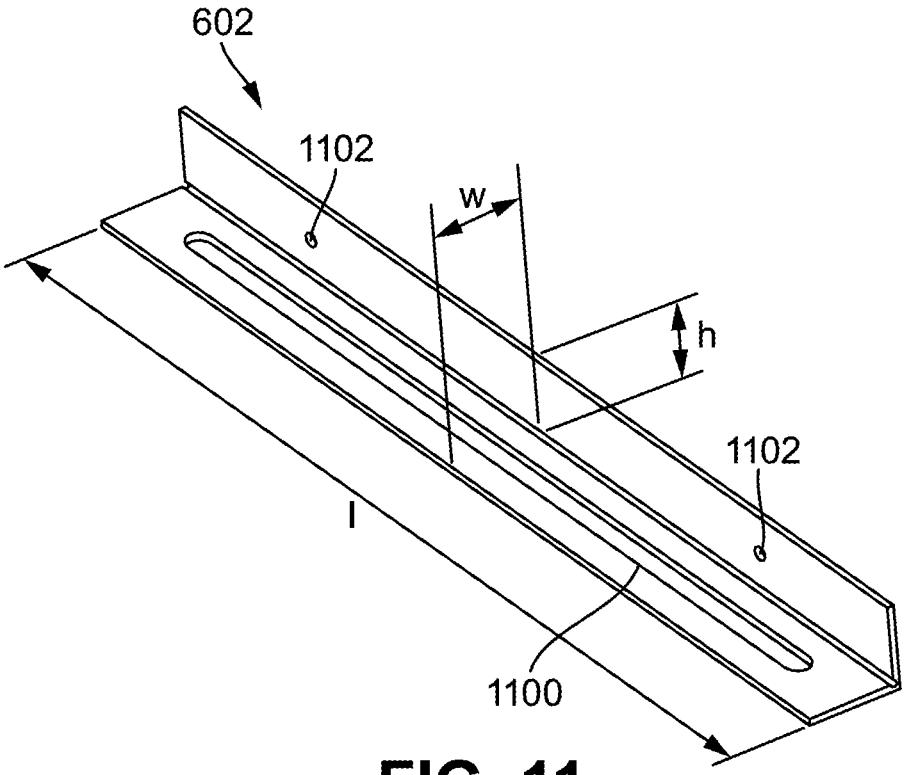
FIG. 11 is a top perspective view of a bracket for a retrofit assembly for a light fixture, such as the light fixture shown in FIG. 1.
Figure 12:
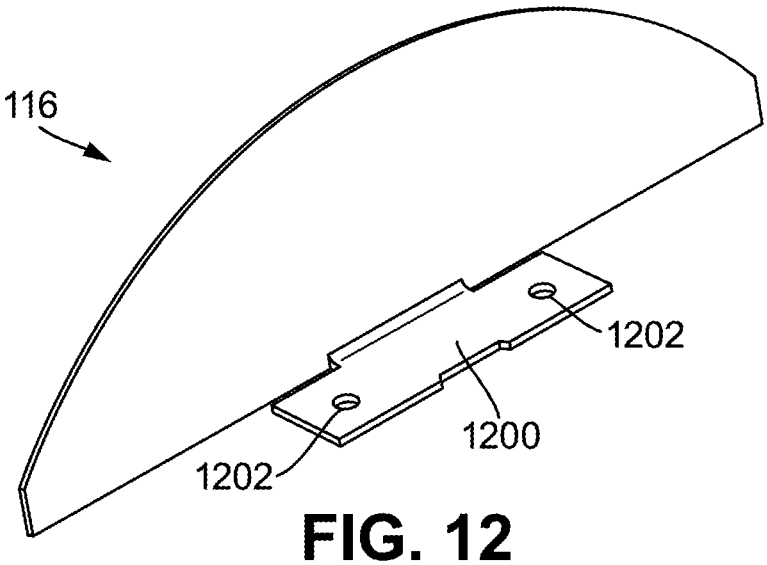

FIG. 11 illustrates bracket 602 in greater detail, although it is understood that similar detail can be found in bracket 604. Bracket 602 includes a slot, shown as a slot 1100. Slot 1100 is configured to receive protrusions (e.g., fasteners, posts, etc.) extending from mounting member 106 and mounting member 108 such that mounting member 106 and mounting member 108 may be supported by, and may be selectively repositioned with respect to, bracket 602. Bracket 602 also includes apertures, shown as holes 1102. Holes 1102 are configured to receive fasteners (e.g., screws, bolts, rivets, etc.) for coupling bracket 602 to flange 900 of base 110. Bracket 602 is defined by a width, w, a length, l, and a height, h. In an exemplary embodiment, the width, w, of bracket 602 is 0.75 inches, the length, l, of bracket 602 is five inches, and the height, h, of bracket 602 is 0.625 inches. In another embodiment, the width, w, of bracket 602 is 0.75 inches, the length, l, of bracket 602 is 9.5 inches, and the height, h, of bracket 602 is 0.625 inches FIG. 12 illustrates endcap 116 in greater detail, although it is understood that similar detail can be found in endcap 118. Endcap 116 includes a flange, shown as flange 1200, having holes, shown as holes 1202. Endcap 116 is coupled to base 110 via fasteners inserted through holes 1202 into base 110.

Figure 13:
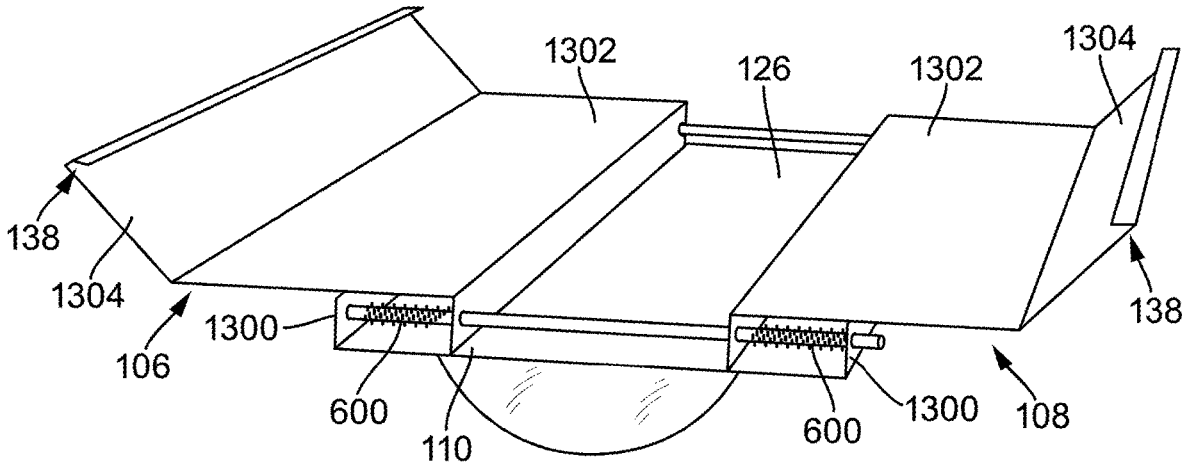
FIG. 13 is a top perspective view of another retrofit assembly for a light fixture, such as the light fixture shown in FIG. 1.

FIG. 13 illustrates the retrofit assembly uninstalled from light fixture 100. As shown in FIG. 13, the retrofit assembly includes a pair of flanges (e.g., wall, edge, etc.), shown as lateral flanges 1300. Lateral flanges 1300 extend along lateral edges of the retrofit assembly. According to the embodiment shown in FIG. 13, mounting member 106 and mounting member 108 are configured to slideably engage top side 126 of the retrofit assembly between lateral flanges 1300. Springs 600 may be, at least partially, attached to lateral flanges 1300. For example, springs 600 may include a rod through each of lateral flanges 1300 upon which mounting member 106 and mounting member 108 are movable.

FIG. 13 also illustrates each of mounting member 106 and mounting member 108 having a first portion, shown as substantially horizontal portion 1302, a second portion, shown as angled portion 1304, and flange 138. Depending on the target application, mounting member 106 and mounting member 108 may have various configurations based on housing 102 associated with the target application, such that flange 138 may engage flange 140. For example, mounting member 106 and mounting member 108 may additionally or alternatively include vertical portions, horizontal portions, curved portions, angled portions, or any other portions such that the retrofit assembly is tailored for a target application.

Figure 14:
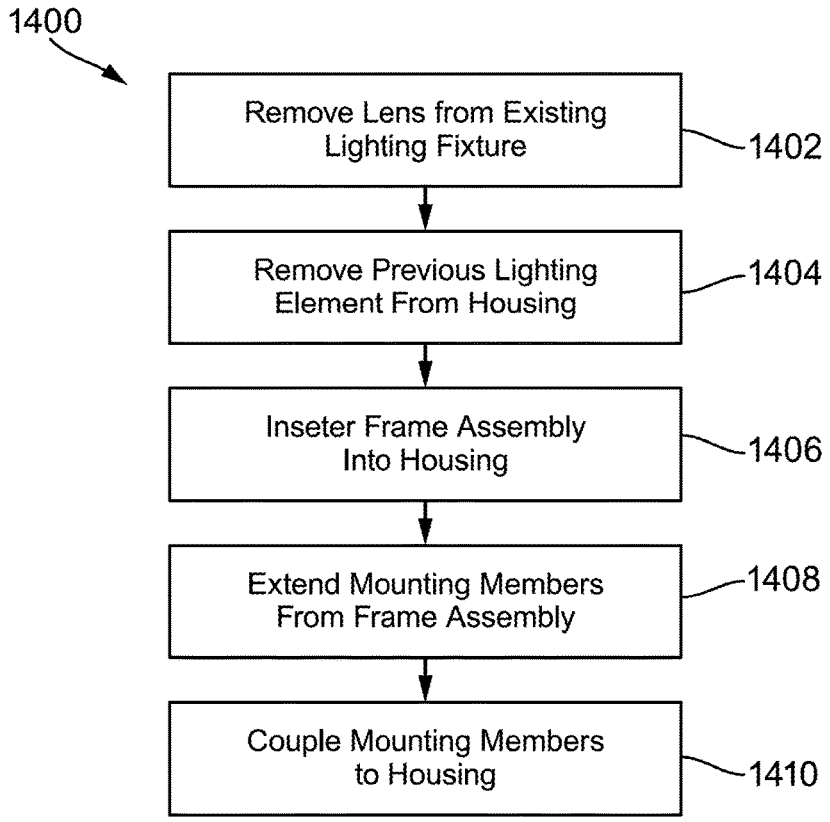
FIG. 14 is a block diagram illustrating a method for retrofitting a light fixture with a retrofit assembly, according to an exemplary embodiment.

FIG. 14 illustrates a method (e.g., process, procedure, etc.), shown as method 1400, for retrofitting an existing lighting fixture with the retrofit assembly. Method 1400 may initially include turning off power to the existing lighting fixture and includes removing a lens of the existing lighting fixture from housing 102 (block 1402). In some applications, it is necessary to remove an endcap prior to removing a lens of the existing lighting fixture from housing 102. Method 1400 also includes removing a previous lighting element (e.g., fluorescent lighting element, etc.) of the existing lighting fixture from housing 102 (block 1404). In various embodiments where the previous lighting element is a fluorescent lighting element, fluorescent lamp, etc., block 1404 includes removing a plate, to which a number of fluorescent light bulb sockets (e.g., tombstones, etc.) are attached, and a ballast, to which the fluorescent light bulb sockets are wired, from the existing lighting fixture. In some applications, block 1404 requires the removal of a ballast cover (e.g., plate, shield, etc.) and disconnecting of wires from the ballast and/or light bulb sockets to a power source. Block 1404 may require the removal of fasteners (e.g., screws, bolts, etc.) or adhesive (e.g., glue, calk, etc.). Method 1400 also includes inserting the retrofit assembly into housing 102 (block 1406). In various embodiments, block 1406 includes wiring LED board 122 to a power supply.

Method 1400 is implemented for the retrofit assembly having selectively extendable mounting member 106 and mounting member 108. Method 1400 may be altered for retrofit assemblies having mounting member 106 and mounting member 108 that do not extend. Method 1400 also includes extending mounting member 106 and/or mounting member 108 from the retrofit assembly (block 1408). For example, mounting member 106 and mounting member 108 may be pulled out by a user to a target length for housing 102 (e.g., such that a bump is received in a target detent, etc.). Method 1400 also includes coupling flange 138 to flange 140 (block 1410). In block 1410, flange 138 may, for example, snap onto flange 140. During block 1410, the retrofit assembly may be pressed into engagement with housing 102 such that the coupling between flange 138 and flange 140 at least partially supports the retrofit assembly in housing 102. In some implementations of method 1400 where the retrofit assembly includes springs 600, block 1410 includes retraction of mounting member 106 and mounting member 108. Block 1410 may also include centering of LED board 122 in housing 102. In some alternative implementations of method 1400, block 1410 is followed by reinstallation of the lens of the existing lighting fixture. For example, if the retrofit assembly does not include lens 120, it may be desirable to reinstall the lens of the existing lighting fixture. While not shown, method may conclude with hanging housing 102 using a ceiling hanging system (e.g., cables, etc.) or coupling housing 102 to a ceiling system (e.g., T-bar ceiling system, etc.).

In application, method 1400 may be implemented in a relatively short amount of time (e.g., a couple minutes or less, less than two minutes, etc.) and without tools. Method 1400 may also facilitate retrofitting of light fixture 100 by a user having ordinary skill without requiring an experienced technician. In this way, the retrofit assembly may reduce costs associated with retrofitting light fixture 100.

Current lighting fixtures do not allow a user to readily upgrade the lighting fixture to the newest hardware available (e.g., LEDs) and/or allow a user to replace only the lighting element of the light fixture in the event of a failure. As a result, users of current lighting fixtures must either opt (a) to replace the entire lighting fixture, (b) to remove the fixture entirely to replace a component thereof, or (c) to service the fixture in-situ. The retrofit assembly facilitates a user upgrade of light fixture 100 at a relatively low cost and in a relatively short amount of time. For example, a user may wish to increase the performance or energy efficiency of light fixture 100. By removing an existing lighting element, a user may install LED board 122 having an upgraded lighting element (i.e., LEDs).

While the retrofit assembly is primarily illustrated coupled to a commercial lighting fixture, it is to be understood that the retrofit assembly may be suitable for residential, outdoor (e.g., area lighting, etc.), and/or industrial lighting (e.g., high bay lighting applications, etc.) as well. It is understood that the particular dimensions supplied herein are only for illustrative purposes; light fixture 100 and the retrofit assembly may have any shape, size, and/or configuration tailored for a target application. Depending on the target application, the retrofit assembly, mounting member 106, mounting member 108, base 110, endcap 116, endcap 118, bracket 602, and bracket 604 may be constructed from steel, aluminum, plastic, composites, polymers, and other similar materials.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes, and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method blocks may be varied or re-sequenced according to alternative embodiments. Other substitutions, modifications, changes, and omissions may be made in the design, operating conditions, and arrangement of the exemplary embodiments without departing from the scope of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary," as used herein to describe various embodiments, is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

What is claimed is:

1. A retrofit assembly for retrofitting an existing light fixture having an existing housing, the retrofit assembly comprising:

a base;

a first mounting member selectively repositionable relative to the base, the first mounting member comprising a first flange configured to selectively couple the first mounting member to the existing housing;

a spring coupled to the base and the first mounting member, the spring configured to bias the first mounting member towards the base and thereby hold the retrofit assembly onto the existing housing;

a second mounting member selectively repositionable relative to the base, the second mounting member comprising a second flange configured to selectively couple the second mounting member to the existing housing; and a lighting element coupled to the base.

2. The retrofit assembly of claim 1, wherein the existing housing has a first width;

wherein the base, the first mounting member, and the second mounting member are configured to facilitate coupling of the first mounting member to a second existing housing having a second width different from the first width.

3. The retrofit assembly of claim 1, further comprising a driver electrically coupled to the lighting element and fixedly coupled to the first mounting member.

4. The retrofit assembly of claim 1, further comprising a battery backup electrically coupled to the lighting element and fixedly coupled to the first mounting member.

5. A retrofit assembly for retrofitting an existing light fixture having an existing housing, the retrofit assembly comprising:

a base;

a first mounting member selectively repositionable relative to the base, the first mounting member comprising a first flange configured to selectively couple the first mounting member to the existing housing;

a second mounting member selectively repositionable relative to the base, the second mounting member comprising a second flange configured to selectively couple the second mounting member to the existing housing, the first flange and the second flange engaged with opposing first and second sides of the existing housing;

a lighting element coupled to the base; and a bracket coupled to the base and slidably engaged with the first mounting member and the second mounting member;

a driver electrically coupled to the lighting element and fixedly coupled to one of the first mounting member and the second mounting member; and a battery backup electrically coupled to the lighting element and fixedly coupled to the other of the first mounting member and the second mounting member.

6. The retrofit assembly of claim 5, further comprising:

a first spring coupled to the base and the first mounting member, the first spring configured to bias the first mounting member towards the base and thereby hold the retrofit assembly onto the existing housing; and a second spring coupled to the base and the second mounting member, the second spring configured to bias the second mounting member towards the base and thereby hold the retrofit assembly onto the existing housing.

7. A light fixture, comprising:

a housing;

a modular assembly, comprising:

a base;

a first mounting member selectively repositionable relative to the base, the first mounting member comprising a first flange configured to selectively couple the first mounting member to the housing;

a spring coupled to the base and the first mounting member, the spring configured to bias the first mounting member towards the base and thereby hold the modular assembly onto the housing;

a second mounting member selectively repositionable relative to the base, the second mounting member comprising a second flange configured to selectively couple the second mounting member to the housing; and a lighting element coupled to the base.

8. The light fixture of claim 7, wherein the housing has a first width;

wherein the base, the first mounting member, and the second mounting member are configured to facilitate coupling of the first mounting member to a second existing housing having a second width different from the first width.

9. The light fixture of claim 7, further comprising a driver electrically coupled to the lighting element and fixedly coupled to the first mounting member.

10. The light fixture of claim 7, further comprising a battery backup electrically coupled to the lighting element and fixedly coupled to the first mounting member.

11. A light fixture, comprising:

a housing;

a modular assembly, comprising:

a base;

a first mounting member selectively repositionable relative to the base, the first mounting member comprising a first flange configured to selectively couple the first mounting member to the housing;

a second mounting member selectively repositionable relative to the base, the second mounting member comprising a second flange configured to selectively couple the second mounting member to the housing;

a lighting element coupled to the base; and a bracket coupled to the base and slidably engaged with the first mounting member and the second mounting member;

a driver electrically coupled to the lighting element and fixedly coupled to one of the first mounting member and the second mounting member; and a battery backup electrically coupled to the lighting element and fixedly coupled to the other of the first mounting member and the second mounting member.

12. A method of installing a lighting element onto a housing of a light fixture, the method comprising:

extending at least one of a first mounting member or a second mounting member relative to a base, wherein the base comprises the lighting element, wherein the base has a first lateral side and a second lateral side, and wherein extending the first mounting member comprises sliding the first mounting member away from the first lateral side of the base, and wherein extending the second mounting member comprises sliding the second mounting member away from the second lateral side of the base;

positioning the first mounting member and the second mounting member adjacent the housing of the light fixture;

withdrawing, by a spring, at least one of the first mounting member or the second mounting member relative to the base, wherein withdrawing the first mounting member comprises sliding the first mounting member toward the second lateral side of the base, and wherein withdrawing the second mounting member comprises sliding the second mounting member toward the first lateral side of the base; and coupling a first flange of the first mounting member and a second flange of the second mounting member to the housing thereby securing the lighting element to the housing of the light fixture.

* * * * *